United States Patent [19]

Atwell

[11] 4,065,024

[45] Dec. 27, 1977

[54] SAFETY CLOSURE FOR PORTABLE RECEPTACLES

[76] Inventor: Max Raymond Atwell, 1461 Kingsberry Drive, Casper, Wyo. 82601

[21] Appl. No.: 620,262

[22] Filed: Oct. 7, 1975

[51] Int. Cl.[2] ..... B65D 47/20; A47G 19/14

[52] U.S. Cl. ..... 220/203; 220/88 A; 220/318; 220/378; 222/469

[58] Field of Search ..... 222/469, 465; 220/318, 220/88 A, 291, 203, 378; 215/1 C; 285/204, 212, 213

[56] References Cited

U.S. PATENT DOCUMENTS

| | | | |
|---|---|---|---|
| 1,436,021 | 11/1922 | Draper | 285/213 |
| 1,447,205 | 3/1923 | Gage | 270/329 |
| 2,014,582 | 9/1935 | Putz | 222/469 |
| 2,133,852 | 10/1938 | Dillhoefer | 285/204 |
| 2,365,695 | 12/1944 | Grice | 220/291 |
| 2,574,876 | 11/1951 | Lebus | 222/469 |
| 2,762,611 | 9/1956 | Monroe et al. | 285/212 |
| 3,727,807 | 4/1973 | Flider | 222/469 |

*Primary Examiner*—William T. Dixson, Jr.
*Assistant Examiner*—Allan N. Shoap
*Attorney, Agent, or Firm*—David H. Hill

[57] ABSTRACT

A safety-adapted pivoted closure device for vessels containing volatile or flammable liquids is disclosed. The disclosed pivoted closure device has a flash arrester and safety vent, with the resulting device being positionable on a vessel, such as a portable receptacle containing gasoline. A spring biases a closure cap on the device toward a closed position, and the spring bias is overcome if a predetermined pressure build-up occurs within the vessel to thus allow the pressure to be relieved. Should this occur, gas and/or fumes are expelled from the vessel, but only through the flash arrester. A handle and linkage assembly are provided for manually moving the cap from a closed position to open the receptacle by overcoming the spring bias thereon with the handle and linkage assembly being designed so as not to prevent release of a pressure build-up within the vessel while the cap is in a closed position. The handle is operatively connected with a linking arm of the linkage assembly by means of a bail, and the handle is movable to a position near the vessel for storage purposes or to prevent accidental opening of the vessel. The device also includes a cylindrical member for adapting a conventional receptacle to receive the safety adapted, pivoted closure device.

6 Claims, 4 Drawing Figures

SAFETY CLOSURE FOR PORTABLE RECEPTACLES

FIELD OF THE INVENTION

This invention relates to a safety closure device and, more particularly, relates to a safety-adapted pivoted closure device containing a flash arrester for vessels containing flammable and volatile liquids.

BACKGROUND OF THE INVENTION

It is oftentimes desirable to provide a vessel for containing and/or storing flammable substances such as gasoline. In some instances, the vessel best suited for such use is a portable receptacle such as the commonly utilized 5 gallon gasoline can known as a "jerry" can.

A vessel containing flammable or volatile liquids such as gasoline presents many problems, due to the volatile nature of such liquids, pressure build-ups which can occur inside the vessel and to static sparks which can occur when pouring the liquid.

The provision of a flash arrester for vessels such as portable receptacles has heretofore been suggested and/or utilized, including a flash arrester that forms a part of a closure assembly rather than being integrally formed with the receptacle itself. Such flash arresters are shown, for example, in U.S. Pat. Nos. 840,992; 1,570,461 and 1,767,642.

In addition, it has heretofore been suggested that closures with pivoted caps could be utilized with containers for storing volatile liquids, and spring-biased venting has also been heretofore suggested and/or utilized with such closures. Pivoted closures with venting are shown, for example, in U.S. Pat. Nos. 2,365,695 and 2,329,716.

Thus, while pivoted closures, as well as closures modified to include a flash arrester and spring-biased venting, have heretofore been suggested and/or utilized, problems have still existed, at least in some instances, in providing a dependable closure device that combines a pivotable cap and flash arrester with a safety venting feature.

SUMMARY OF THE INVENTION

This invention provides an improved safety closure device having a flash arrester and safety venting only through the flash arrester. The closure device is particularly well suited for portable receptacles containing flammable or volatile liquids, and includes a linkage for pivoting a closure cap that is normally spring biased toward a closed position, the spring bias being overcome when a predetermined pressure build-up occurs within the receptable to allow substances therein, such as gases and fumes, to be expelled from the receptable, but only through the flash arrester, to thus relieve the pressure and explosion hazard within the receptacle. Air vents in the receptacles are sealed by the closure device to prevent gas from escaping except through the flash arrester.

It is therefore an object of this invention to provide an improved safety closure device.

It is another object of this invention to provide an improved safety closure device that is simple in construction yet dependable in operation.

It is still another object of this invention to provide an improved safety closure device that includes a flash arrester and safety venting though the flash arrester, rather than through air vents that allow gases to escape other than through a flash arrester.

It is yet another object of this invention to provide an improved safety closure device for use with a portable receptacle.

It is still another object of this invention to provide an improved safety closure device for use with a portable receptacle containing flammable liquids, and for sealing air vents in the receptacle.

It is another object of this invention to provide an improved safety closure device having a linkage for pivoting a closure cap that is spring biased toward a closed position.

It is still another object of this invention to provide an improved safety closure device having a spring-biased closure cap the bias on which is overcome when a predetermined pressure build-up occurs within a vessel, to relieve the pressure therein by expelling gases and/or fumes from the vessel through a flash arrester.

It is yet another object of this invention to provide an improved safety closure device having a linkage and handle to actuate the linkage, said handle being movable to a position near the vessel for storage purposes and/or to prevent accidental opening of the closure.

With these and other objects in view, which will become apparent to one skilled in the art as the description proceeds, this invention resides in the novel construction, combination, and arrangement of parts substantially as hereinafter described and more particularly defined by the appended claims, it being understood that such changes in the precise embodiment of the herein disclosed invention are meant to be included as coming within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
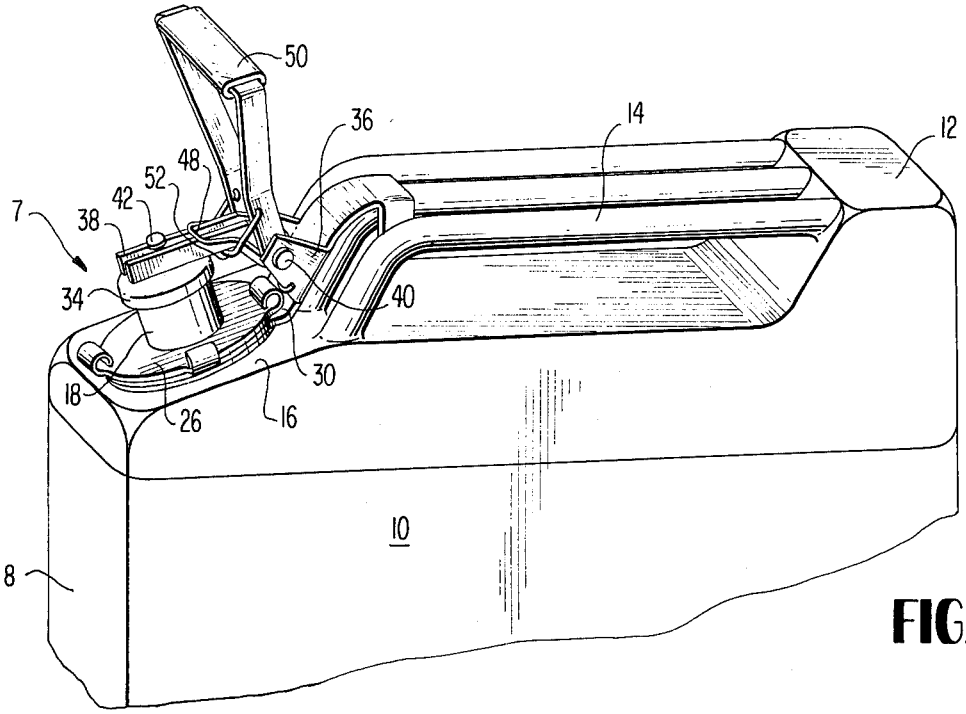
FIG. 1 is a perspective view of a portable receptacle with the safety closure device of this invention mounted thereon.

Referring now to the drawings, the numeral 7 refers generally to the safety closure device of this invention shown mounted on a vessel, or portable receptacle, 8. Portable receptacle 8 is shown as a five gallon gas can normally referred to as a "jerry" can, which conventionally includes sidewalls 10, a bottom wall (not shown), and a top wall 12 modified to have a carrying handle 14 integrally formed therein. As also shown, a portion 16 of the top wall is slanted and has a filling opening formed therein, as is conventional. The safety closure device 7 of this invention is mounted on the vessel 8 with a portion thereof extending through the filling opening in the slanted portion of the top wall.

Figure 2:
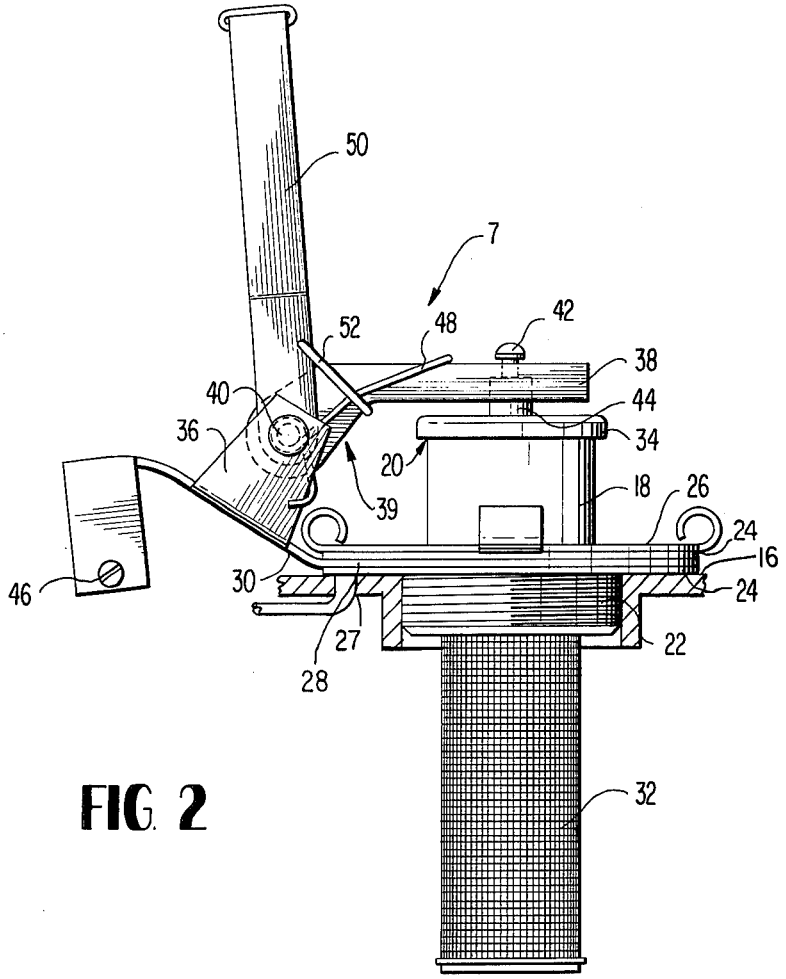
FIG. 2 is a side view of the safety closure device shown in FIG. 1.

The safety closure device is best shown in FIG. 2 to include a cylindrical member or sleeve 18, one portion of which extends outwardly from the vessel when the closure device is in an operative position mounted on the vessel. The cylindrical member terminates, at the end extending away from the vessel, in a mouth portion 20.

A vessel-engaging portion 22 has external threads thereon to mate with the internally threaded filling opening in a "jerry" type gas can, as is conventional. A seal is established between the vessel and the closure device, when the closure device is in an operative position, by the relationship between the externally threaded closure device and the internally threaded filling opening in conjunction with dual gaskets 24 between the top of the vessel and a flange 26 extending from the cylindrical member 18. The seal established also permanently closes the air vent 27 conventionally found in the "jerry" type gas can to prevent escape of gas through such vent. An ear 28 of pivot or attachment plate 30 is positioned between the dual gaskets 24.

A flash arrester 32 of conventional design is fastened to the cylindrical member 18 and extends inwardly into a vessel when the closure device is in operative position mounted thereon. As shown in FIG. 2, the flash arrester is a foraminous cylinder formed of wire mesh or a fine baffle and completely spans or surrounds the bottom of the cylinder 18 so thaat substances (liquid or gas) must pass through the flash arrester both when being injected into the vessel or being expelled therefrom. This includes, of course, any substance, including gases and/or fumes, expelled from the vessel to relieve a pressure build-up therein.

The mouth portion 20 of the cylindrical member 18 is closed by a closure cap 34 spanning the same to establish a seal when in the closed position.

Attachment plate 30 has a pivot flange member 36 (a pair of spaced flange members can be utilized if desired) upon which an arm 38 of linkage 39 is pivoted at one end by means of pivot pin 40. Linking arm 38 extends at the other end portion over closure cap 34, which is connected with the arm by means of pin 42 fastened to top portion 44 of cap 34. If desired, the connection between arm 40 and pin 42 can provide for limited movement therebetween, as indicated to be possible in FIG. 2. A clamp screw 46 for the attachment plate may also be provided as shown in FIG. 2.

A spring 48 is connected between linkage arm 38 and flange 36 of attachment plate 30 to bias the arm towards the cylindrical member to thus bias the cap toward a closed position. Spring 48 is chosen so that a predetermined pressure is needed inside the vessel before the spring bias can be overcome to allow a pressure build-up within the vessel to be relieved. It has been found that a pressure of about 5 pounds per square inch (PSI) exerted to overcome the spring bias is satisfactory.

A handle 50 is also pivoted on the pivot pin 40 and a bell crank assembly bail 52 provides an operative connection between the handle and linking, or bell crank, arm 38.

Figure 3:
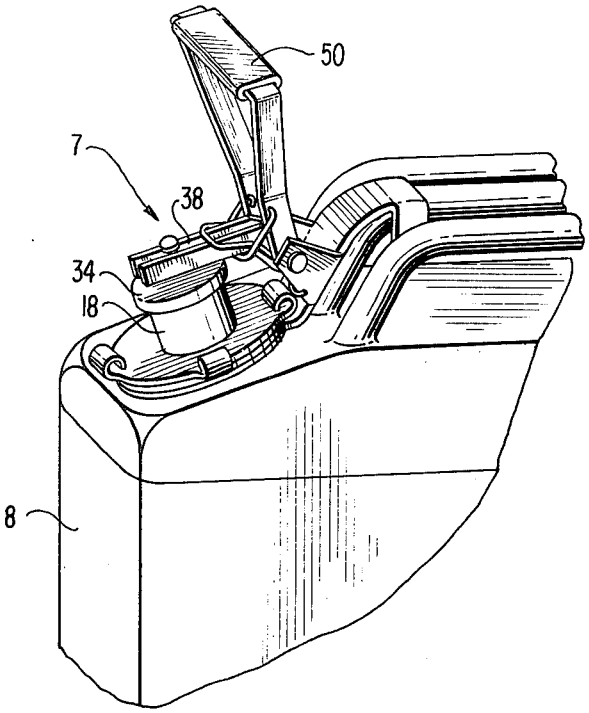
FIG. 3 is a perspective view showing the safety closure device with the closure cap in a closed position, but with the handle in position to actuate the same from the closed position.
Figure 4:
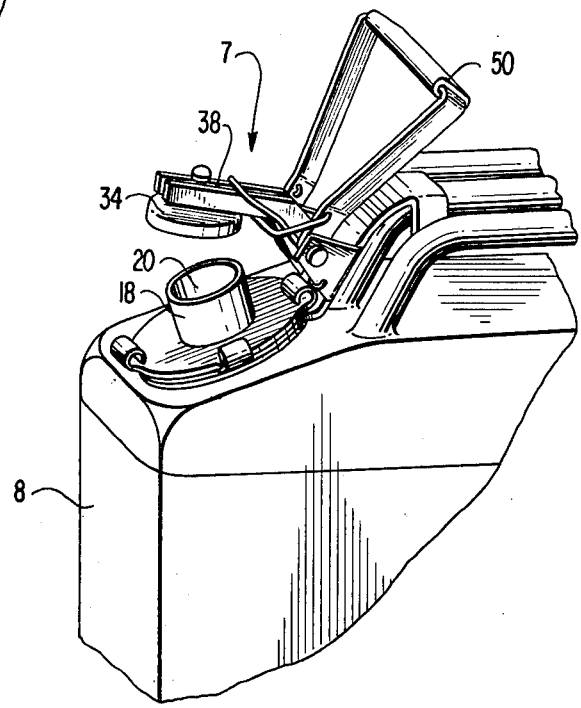
FIG. 4 is a perspective view showing the safety closure device with the closure cap actuated to an open position.
Figure 5:
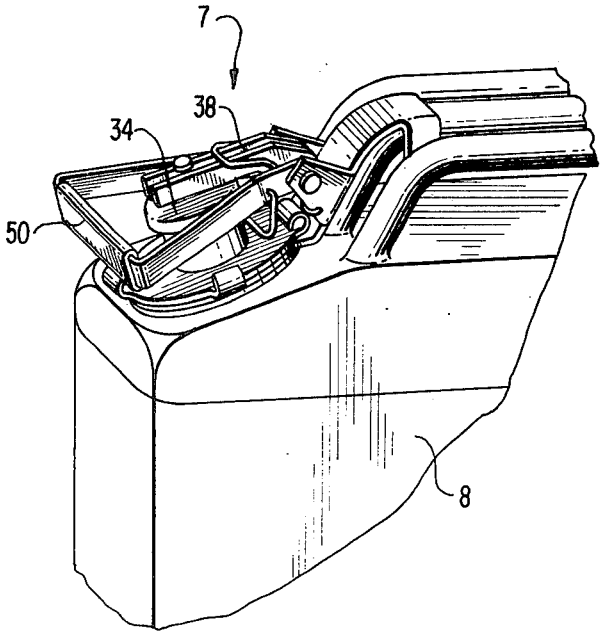
FIG. 5 is a perspective view showing the safety closure device with the handle moved to a position near the receptacle.

Operation of the closure device for manually activating the closure cap from the closed position and for moving the handle 50 to a storage position is shown in FIGS. 3 through 5. As shown in FIG. 3, the handle is ready to actuate the closure cap from the closed position (the cap is normally maintained in a closed position by spring bias). By rotating or pivoting the handle back toward the rear of the vessel as shown in FIG. 4, the closure cap is raised from the closed position to an open position. As the handle is pivoted, the linking arm is pivoted so that the free end of the arm is moved upwardly and away from the mouth portion of the cylindrical member, and this raises the cap away from the mouth portion. Upon release of the handle, or pivoting the same in the opposite direction (forwardly as shown in FIGS. 3 through 5), the cap is freed to resume its normal closed position sealing the mouth portion of the cylindrical member due to the spring bias provided by spring 48. For storage and/or to prevent accidental opening of the vessel, the handle 50 is pivoted forwardly until it is contiguous to the vessel and the cylindrical member, as shown in FIG. 5. As can be seen from FIG. 2, this actuation of the handle does not affect the closure cap due to the operative connection provided by bail 52, and relieving of a pressure build-up within the vessel is not adversely affected.

If a pressure build-up should occur that equals or exceeds the predetermined pressure, the cap will be forced upwardly, overcoming the spring bias thereon, and the pressure will thus be relieved by expelling fumes and/or gases from the vessel through the flash arrester. Thus, venting from the vessel can be achieved only through the flash arrester to provide an additional safety factor.

The invention has been described in detail with respect to a specific preferred embodiment. However, various other embodiments incorporating the inventive concept of the disclosure may occur to those skilled in the art. Hence, the invention is not to be considered as being limited to the particular details given, nor to the specific application to which reference has been nade during the description of the apparatus, except insofar as may be required by the scope of the appended claims.

What is claimed is:

1. A unitary safety pouring and sealing accessory for vessels of the type having a primary opening therein for permitting ingress and egress of liquids and a relatively small venting opening adjacent and coplanar with such primary opening for normally venting the interior of such vessel to the surrounding atmosphere when said primary opening is closed, comprising flash-arresting means, intermediate means connected to said flash-arresting means and having a mouth-defining means for the ingress and egress of fluids passing through said flash-arresting means, cap means forming a closure for said mouth-defining means, biasing means for resiliently urging said cap means into sealing contact with said mouth-defining means, securing means intermediate said flash-arresting means and said mouth-defining means for removably securing said unitary safety accessory in the primary opening of such a vessel with said flash-arresting means positioned within such vessel and said mouth-defining means exterior thereof, and an imperforate annular gasket means and cooperating flange means contiguous with said securing means and encircling said accessory, said gasket means and said flange means being adapted to form a fluidtype seal between said accessory and the vessel around such primary opening therein, said annular gasket means and said flange means having a sufficient outer diameter to overlie and sealingly close the adjacent venting opening in such vessel, whereby the sole means of ingress and egress of fluids into and from such vessel is through said flash-arresting means.

2. A unitary safety pouring and sealing accessory in accordance with claim 1, wherein said sensing means for removably securing said accessory to such vessel includes a threaded connector adapted to engage a cooperating threaded connector in such primary opening of such vessel.

3. A unitary safety pouring and sealing accessory in accordance with claim 1, wherein said flash-arresting means includes a foraminous member.

4. A unitary safety pouring and sealing accessory in accordance with claim 1, wherein said biasing means for resiliently urging said cap means exerts a predetermined force on said cap means, whereby pressures within such vessel in excess of said predetermined force will open such cap means to vent the interior of such vessel to the atmosphere through said flash-arresting means.

5. A unitary safety pouring and sealing accessory in accordance with claim 4, and including handle means for manually overcoming said biasing to open said cap means.

6. A unitary safety pouring and sealing accessory in accordance with claim 5, and including lost-motion means between said handle means and said cap means, whereby said cap means is free for venting action irrespective of the position of said handle means.

* * * * *